US007500372B2

(12) United States Patent
Caporusso et al.

(10) Patent No.: US 7,500,372 B2
(45) Date of Patent: Mar. 10, 2009

(54) BENDING MACHINE WITH A CONTROLLED-RETURN BENDING DIE

(75) Inventors: Alessandro Caporusso, Piedimonte San Germano (IT); Mario Giorgio, Piedimonte San Germano (IT)

(73) Assignee: CML International S.p.A., Piedmonte San Germano (IT)

( * ) Notice: Subject to any disclaimer, the term of this patent is extended or adjusted under 35 U.S.C. 154(b) by 24 days.

(21) Appl. No.: 11/344,119

(22) Filed: Feb. 1, 2006

(65) Prior Publication Data

US 2006/0174672 A1 Aug. 10, 2006

(30) Foreign Application Priority Data

Feb. 4, 2005 (IT) ..... RM2005A0049

(51) Int. Cl.
*B21D 7/04* (2006.01)
*B21D 9/05* (2006.01)
*B21J 9/18* (2006.01)

(52) U.S. Cl. ..... 72/149; 72/155; 72/156; 72/453.18

(58) Field of Classification Search ..... 72/149, 72/154, 155, 156, 217, 453.01, 453.18
See application file for complete search history.

(56) References Cited

U.S. PATENT DOCUMENTS

| | | | | |
|---|---|---|---|---|
| 2,312,122 | A | 2/1943 | Parker et al. | |
| 2,667,202 | A * | 1/1954 | Froedge | 72/156 |
| 2,871,909 | A * | 2/1959 | Bower | 72/321 |
| 3,016,943 | A | 1/1962 | Kilham | |
| 3,205,690 | A * | 9/1965 | Roessler, Jr. | 72/150 |
| 4,063,441 | A | 12/1977 | Eaton et al. | |
| 4,552,006 | A * | 11/1985 | Yogo | 72/149 |

FOREIGN PATENT DOCUMENTS

DE 11 78 678 9/1964

* cited by examiner

*Primary Examiner*—Dana Ross
*Assistant Examiner*—Teresa Bonk
(74) *Attorney, Agent, or Firm*—Young & Thompson

(57) ABSTRACT

A bending machine with a controlled-return bending die includes a matrix (2) mounted around a spindle (3) having an axis y, a bend arm (4) being able to turn around on the same axis y, and a vice (5) adapted to clamp a section of a workpiece to be bent. A driving element causes the bend arm (4) and the matrix (2), both being connected together by the vice (5), to rotate around the axis y for a set angle from a start position, and a workpiece bending operation is performed for a workpiece section corresponding to the angle. The bend arm (4) carries on itself a controlled return element able to return the matrix (2) to its start position at the end of workpiece bending operation.

4 Claims, 4 Drawing Sheets

BENDING MACHINE WITH A CONTROLLED-RETURN BENDING DIE

FIELD OF THE INVENTION

The present invention relates to a bending machine with a controlled-return bending die.

BACKGROUND OF THE INVENTION

Bending machines have a bending device comprising a bending die or matrix and a bend arm, both rotating about an axis and being provided with co-operating counteracting members. These counteracting members clamp a section of a workpiece immediately after the section to be bent, according to a feeding direction of the workpiece in the bending machine. The workpiece is bent by causing both the matrix and the bend arm to move around the axis from an initial position to an end position. When a bending operation ends, the matrix is caused to return to its initial position.

Conventionally, a mechanism that is built-in or connected to a stationary part of the bending machine causes the matrix to return to its initial position. This implies some drawbacks, which are joined to the fact that said mechanism outside the bend arm might interfere with the bending operation.

SUMMARY OF THE INVENTION

In order to solve this problem, a matrix returning means has been provided being housed in the bend arm in the form of a spring element. However, this solution, according to which the matrix is automatically returned, has been abandoned because its operation is dangerous. Among other things, an automatic return of the matrix by means of a spring element is not always assured owing to the friction, the weight of the matrix and other causes, also in consideration that the spring member cannot be calibrated.

An object of the present invention is to allow a bending machine matrix to return to its start or initial position of bending operation safely and reliably by a control, whether the control is operated by a worker or whether the control is part of an automatic cycle.

Another object of the invention is to provide a mechanism for returning the matrix to its initial position that does not hinder the bending operation.

Therefore, the invention provides a bending machine with a controlled-return bending die, including a bending die or matrix mounted around a spindle having an axis y, a bend arm able to turn around on the same axis y, and co-operating counteracting means for clamping a section of workpiece to be bent in a start position of the matrix and the bend arm, a workpiece bending operation being performed for a workpiece section corresponding to an angle of rotation of the bend arm and the matrix around the axis y by driving means, the bend arm carrying on itself a controlled return means able to return the matrix to its start position at the end of workpiece bending operation.

BRIEF DESCRIPTION OF THE DRAWINGS

The present invention will be described referring to a preferred embodiment thereof in connection with the enclosed drawings, in which.

DETAILED DESCRIPTION OF A PREFERRED EMBODIMENT

Figure 1:
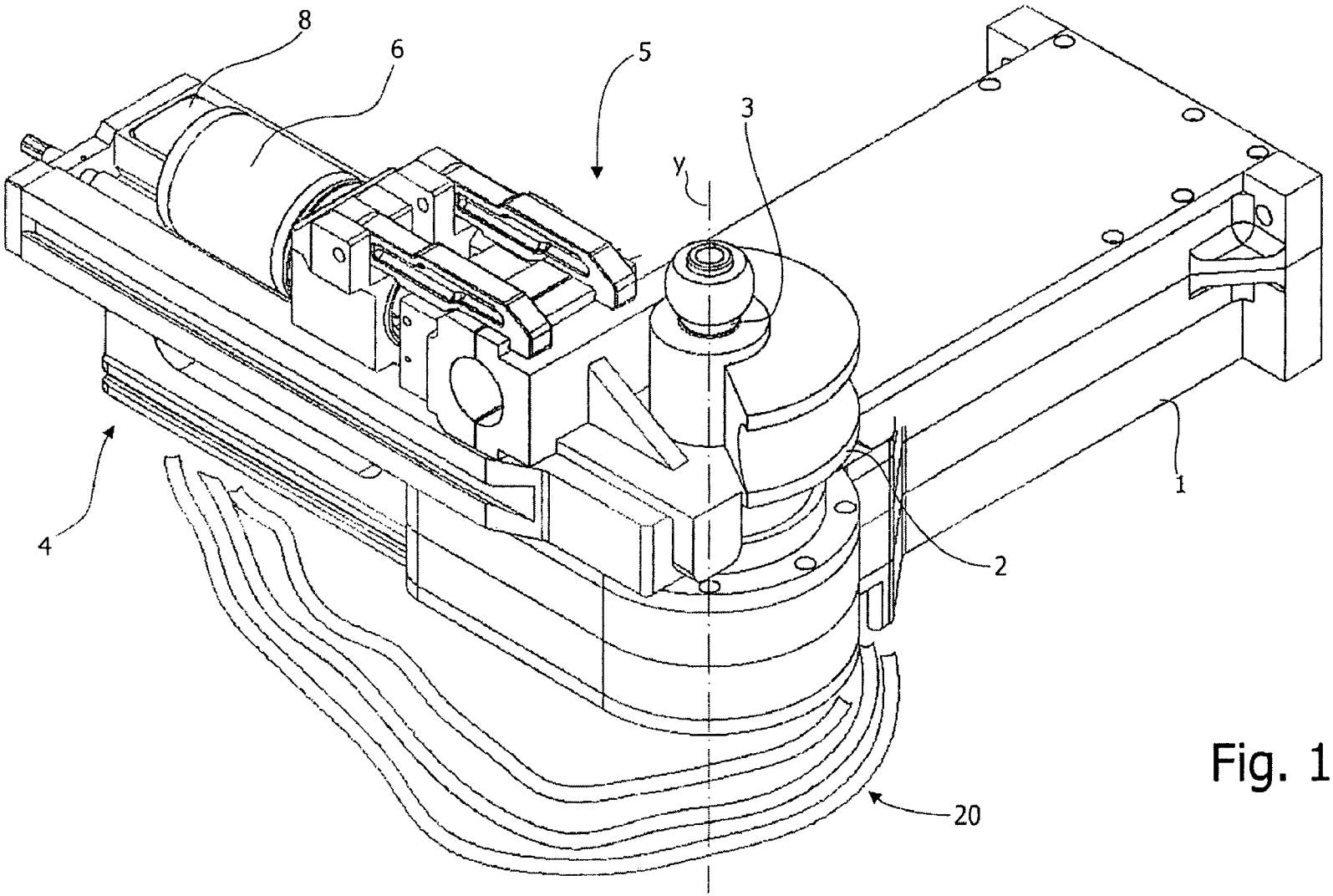
FIG. 1 shows a fragmentary perspective view of a bending machine in which the present invention is embodied, only a matrix and a bend arm of the bending machine being represented in an initial position of bending operation.

With reference to the drawings, in FIG. 1 there is shown a bending machine in a fragmentary perspective view. On a support bench 1, which is connected to the rest of the bending machine (not shown), a bending die or matrix 2 is mounted around a spindle 3 having an axis y. A bend arm generally indicated as 4, is able to turn around on the same axis y. A vice 5 using a double-acting cylinder 6 is mounted on the bend arm 4. The vice 5 is an example of counteracting means for a workpiece, generally a pipe, to be bent (not shown). The counteracting means being adapted to clamp a section of pipe to be bent in its start or initial bending position can be different from those shown here. The same vice 5 connects the bend arm 4 to the matrix 2.

After a set angle rotation of the bend arm 4 and the matrix 2, connected thereto, by driving means (not shown), a pipe bending operation on the matrix is performed for a pipe section corresponding to set angle.

Hoses feeding a pressured fluid and electric wires are shown in FIG. 1 and generally indicated as 20. Two of the hoses 20 serve the double-acting cylinder 6, while one of them is for a single-acting cylinder that will be described below.

According to the invention, the matrix 2 is returned to the start position by return means acting on the matrix when the pipe bending operation is finished, after the bent pipe is removed from the bending machine. The return means is operated by a worker at the bending machine or by a control system.

Figure 2:
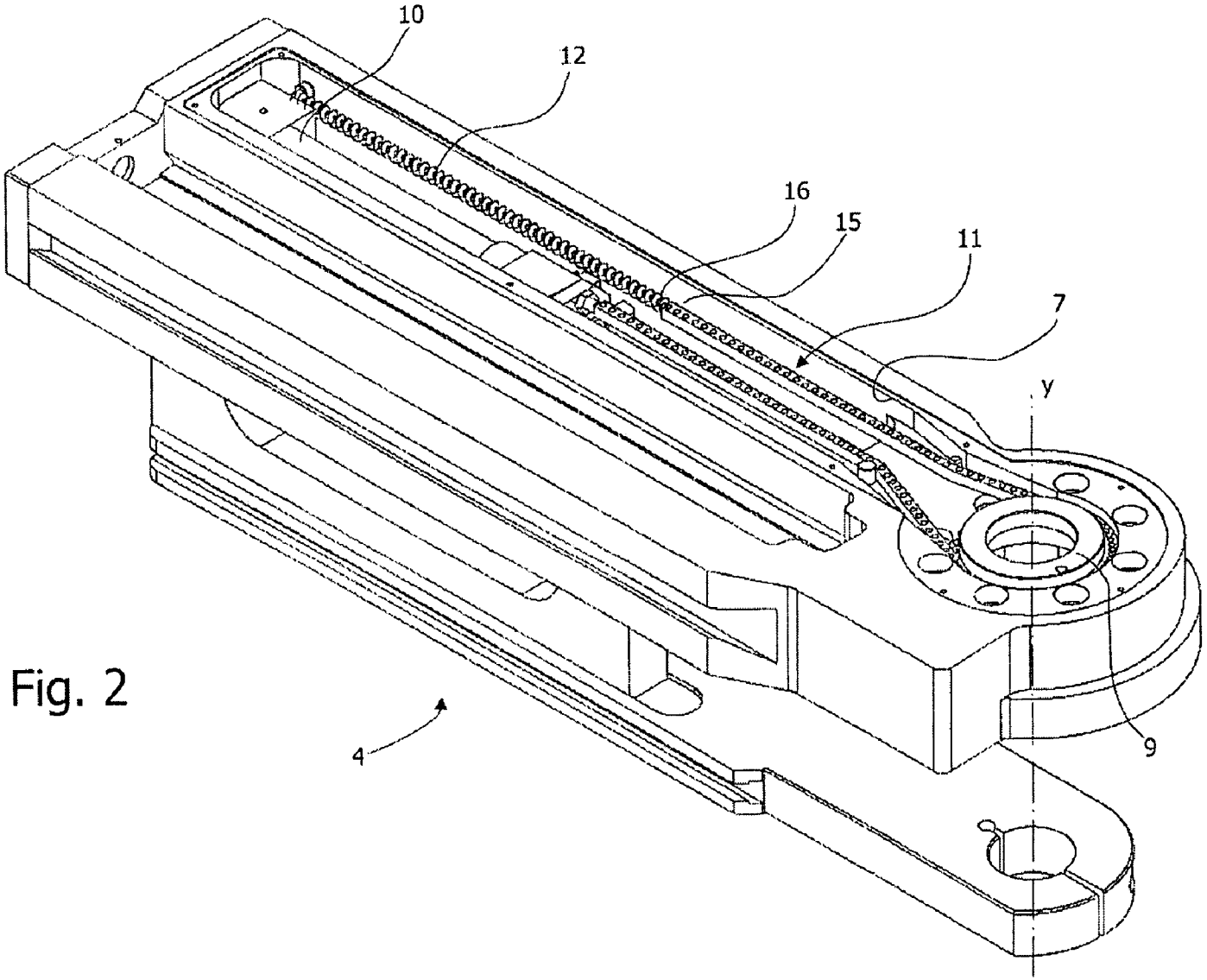
FIG. 2 shows a perspective view of the bend arm in FIG. 1, with parts being removed to show return means of the matrix to the initial operation position.
Figure 3:
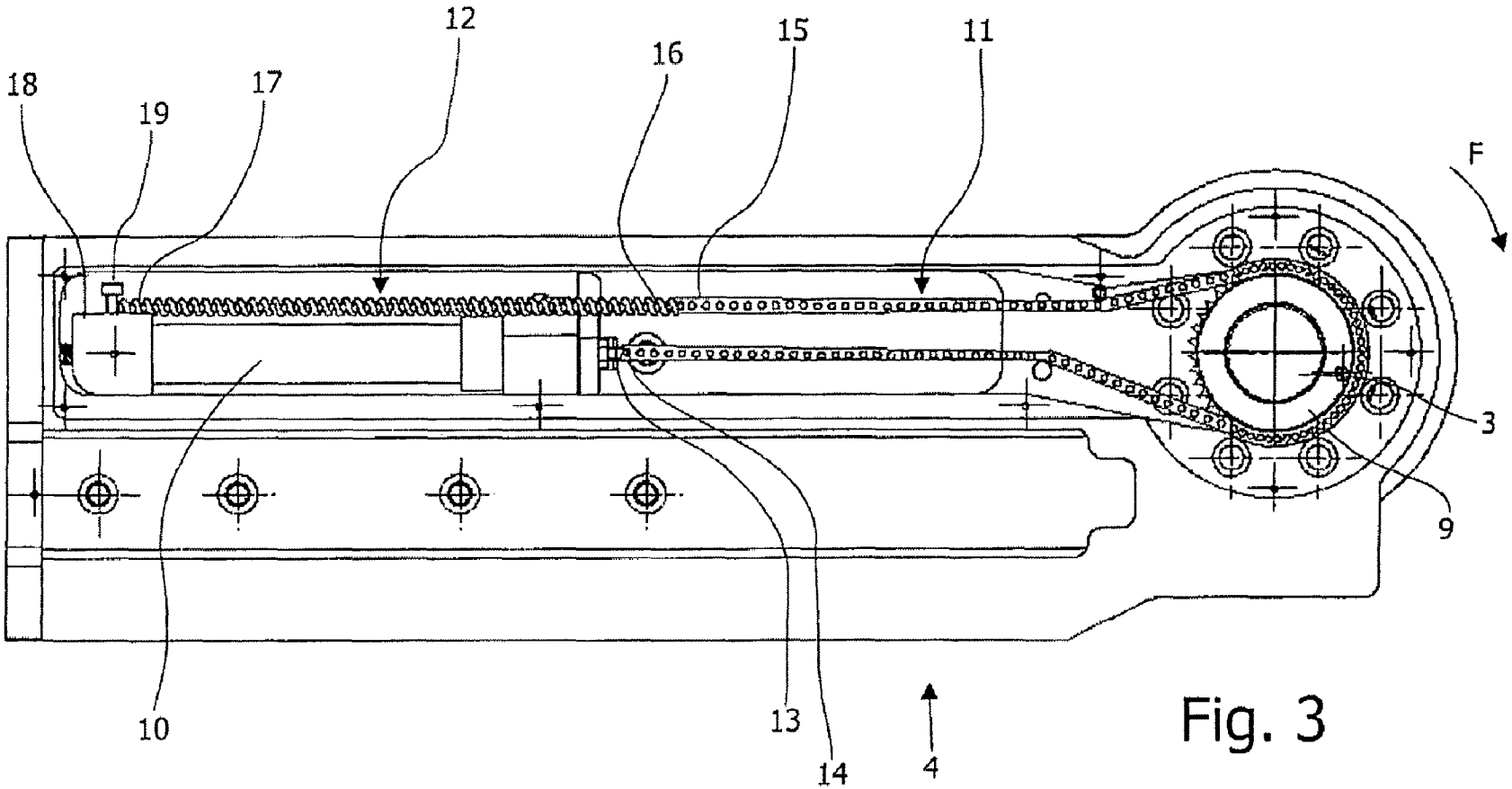
FIG. 3 shows the bend arm in FIG. 1 in a top plan view.
Figure 4:
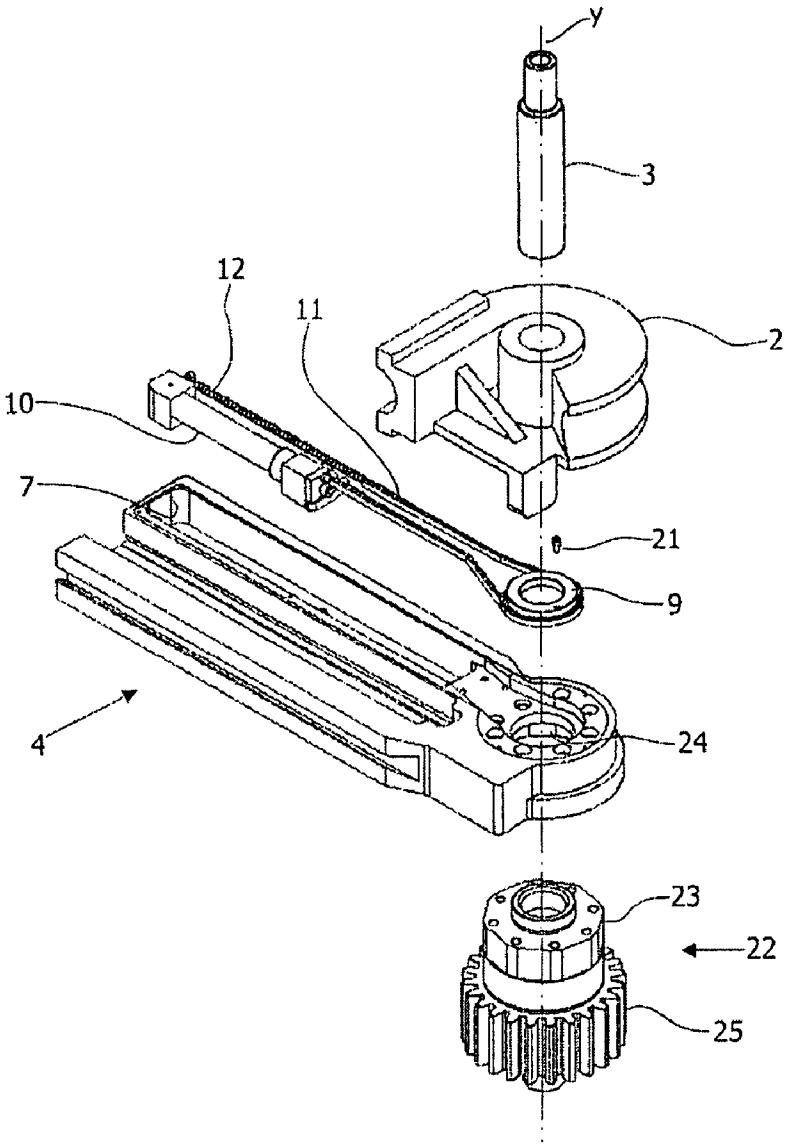
FIG. 4 shows an exploded perspective view of return means for the matrix in a bending machine according to the invention.

This return means is housed in a compartment 7, as shown in FIG. 2, which is a fragmentary perspective view of the bending device. The compartment 7 is provided in an upper part of the bend arm 4 and is closed by a removable cover element 8 (FIG. 1). The return means acts on a power transmission element that is pivoted around the axis y since it is connected to the spindle 3, as best shown in the top plan view of FIG. 3 and in the exploded view of FIG. 4. The power transmission element, which is further connected to the matrix, is a ring gear 9.

In particular, according to an embodiment thereof, the controlled return means comprises a single-acting cylinder 10, a section of flexible transmission 11 and an elastic stretching member 12. Such an embodiment is depicted in particular in FIG. 4, where a dowel for connecting the ring gear 9 to the matrix 2, which is freely able to turn around the spindle 3, is indicated as 21. The spindle 3 acts as a locating pivot and is supported on a driving shaft 22. The driving shaft 22 has a polygonal portion 23 designed to engage a correspondent seat 24 in the bend arm 4, and also a spur gear 25 being engaged with driving means for turning the bend arm 4. Said driving means, which can be configured variously, is not described in detail since it is conventional.

The single-acting cylinder 10 is fixed inside the compartment 7 in the bend arm 4. A free end 13 of the piston rod of the single-acting cylinder 10 is connected to an end 14 of the section of flexible transmission 11. The flexible transmission 11 is preferably a chain running on the ring gear 9, whose teeth mesh with chain links. The flexible transmission 11, beyond the ring gear 9, is attached with the other end 15 thereof to an end 16 of the elastic stretching member 12. The other end 17 of the elastic stretching member 12 is fixed by a pin 19 to a portion 18 being in any way rigidly connected to a fixed portion of the bend arm 4 inside the compartment 7, e.g. the portion 18 being integral with the same single-acting cylinder 10. Finally, the elastic stretching member 12 counteracts the piston rod of the single-acting cylinder.

The ring gear 9 is the power transmission element that is keyed to the spindle 3 and co-operates with the section of flexible transmission 11. The ring gear 9 is able to transform a traction applied to the flexible transmission 11 by the single-acting cylinder 10 into a rotation of the matrix 2 in a direction opposite the rotation caused by driving means of the bend arm 4, in order to return the matrix to the start position of bending operation. This can be performed only after a bent workpiece has been removed from the bending machine.

The single-acting cylinder 10 has its axis substantially perpendicular to the axis y of the spindle 3 and the free end 13 of the its piston rod is directed toward the spindle 3.

The elastic stretching member 12 is e.g. a traction resistant helical spring.

In the operation for bending a section of workpiece (not shown), the bend arm 4 is rotated by driving means of the bending machine, such as an electric or hydraulic motor, which are not described in detail, neither depicted in figures. When the bend arm 4 rotates around the axis y, the piston rod of the single-acting cylinder is pulled out by means of the section of flexible transmission 11 with a consequent shortening of the elastic stretching member 12. When the worker wants the matrix 2 to return to the start position of bending operation, the single-acting cylinder is fed with fluid which displaces the piston rod inside. The displacement of the piston rod transmits the traction to the section of flexible transmission 11 that being engaged with the ring gear 9 causes the matrix 2 to be rotated in the direction of the arrow F (see FIG. 3) to return it to the start position shown in FIG. 1.

The invention has been described by way of example, and variations and changes can be made without departing from the scope of the enclosed claims.

What is claimed is:

1. A bending machine with a controlled-return bending die, comprising:

a bending die or matrix mounted around a spindle having an axis y, a bend arm able to turn around on the same axis y, and co-operating counteracting means for clamping a section of workpiece to be bent in a start position of the matrix and the bend arm, a workpiece bending operation being performed for a workpiece section corresponding to an angle of rotation of the bend arm and the matrix around the axis y by a driving shaft, the driving shaft having a polygonal portion adapted to engage a corresponding seat, wherein said bend arm carries on itself a controlled return means able to return said matrix to its start position at the end of said workpiece bending operation, wherein said controlled return means comprises:

a single-acting cylinder fed with fluid being fixed on said bend arm and having a piston rod with a free end;

a section of flexible transmission having one end being connected to the free end of said piston rod, and the other end being attached to an elastic stretching member comprising a traction resistant helical spring in one end thereof, the other end of the elastic stretching member being fixed to a portion rigidly connected to said bend arm, the elastic stretching member counteracting the piston rod of the single-acting cylinder, said section of flexible transmission being a link chain;

a power transmission element that is a ring gear connected to the matrix and co-operating with said section of flexible transmission, the power transmission element being able to transform a traction movement applied to said section of flexible transmission into a rotation movement of the matrix around said axis y in a direction opposite the rotation that has been caused by said driving shaft to bend the workpiece, in order to return said matrix to a start position, and wherein return of the bending die or matrix to the start position is performed only after a bent workpiece has been removed from the bending machine.

2. The bending machine as claimed in claim 1, wherein that said controlled return means are housed in a compartment, which is provided in an upper part of said bend arm and closed by a removable cover element.

3. A bending machine with a controlled-return bending die, comprising:

a bending die or matrix mounted around a spindle having an axis y;

a bend arm able to turn around on the same axis y; and a co-operating counteracting device configured for clamping a section of workpiece to be bent in a start position of the matrix and the bend arm, a workpiece bending operation being performed for a workpiece section corresponding to an angle of rotation of the bend arm and the matrix around the axis y by a driving shaft, the driving shaft having a polygonal portion adapted to engage a corresponding seat, wherein said bend arm carries on itself a controlled return device able to return said matrix to its start position at the end of said workpiece bending operation, wherein said controlled return device comprises:

a single-acting cylinder fed with fluid being fixed on said bend arm and having a piston rod with a free end;

a section of flexible transmission having one end being connected to the free end of said piston rod, and the other end being attached to an elastic stretching member comprising a traction resistant helical spring in one end thereof, the other end of the elastic stretching member being fixed to a portion rigidly connected to said bend arm, the elastic stretching member counteracting the piston rod of the single-acting cylinder, said section of flexible transmission being a link chain;

a power transmission element that is a ring gear connected to the matrix and co-operating with said section of flexible transmission, the power transmission element being able to transform a traction movement applied to said section of flexible transmission into a rotation movement of the matrix around said axis y in a direction opposite the rotation that has been caused by said driving shaft to bend the workpiece, in order to return said matrix to a start position, and wherein return of the bending die or matrix to the start position is performed only after a bent workpiece has been removed from the bending machine.

4. The bending machine as claimed in claim 3, wherein that said controlled return device is housed in a compartment, which is provided in an upper part of said bend arm and closed by a removable cover element.

* * * * *